United States Patent [19]

Lanier

[11] Patent Number: 4,576,549

[45] Date of Patent: Mar. 18, 1986

[54] VORTEX GENERATOR FOR CENTRIFUGAL FANS

[75] Inventor: Robert L. Lanier, Niles, Mich.

[73] Assignee: Garden City Fan & Blower Co., Niles, Mich.

[21] Appl. No.: 470,398

[22] Filed: Feb. 28, 1983

Related U.S. Application Data

[63] Continuation of Ser. No. 165,767, Jul. 3, 1980, abandoned.

[51] Int. Cl.[4] ..... F04D 17/08

[52] U.S. Cl. ..... 415/209; 415/DIG. 1; 415/206; 415/219 C

[58] Field of Search ..... 415/204, 206, 219 A, 415/219 C, DIG. 1, 119, 209, 210

[56] References Cited

U.S. PATENT DOCUMENTS 2,452,274 10/1948 Walters .
2,841,326 7/1958 Davis ..... 415/204
2,951,630 9/1960 Murphy .
3,085,741 4/1963 Burkhardt .
3,191,851 6/1965 Wood .
3,221,983 12/1965 Trickler et al. .
3,307,776 3/1967 White .
3,523,743 8/1970 Jolette .
4,177,007 12/1979 Schlangen ..... 415/206

FOREIGN PATENT DOCUMENTS 679982 2/1964 Canada .

*Primary Examiner*—Samuel Scott
*Assistant Examiner*—B. J. Bowman
*Attorney, Agent, or Firm*—McDougall, Hersh & Scott

[57] ABSTRACT

A centrifugal fan having a plurality of formed vortex generators fixed onto the outer wall of an annular member leading into the air inlet for the fan-wheel to cause mixing of the slower air discharged from the wheel and the skin friction air current created by the wheel.

10 Claims, 10 Drawing Figures

VORTEX GENERATOR FOR CENTRIFUGAL FANS

This is a continuation of application Ser. No. 165,767, filed July 3, 1980, now abandoned.

This invention relates to improvements in the construction of centrifugal fans.

BACKGROUND OF THE INVENTION

Centrifugal fans, of the type to which this invention relates, involve a fan-wheel rotatively mounted in a scroll-spiral type housing having an axial air-inlet and air-outlet in a plane parallel to the axis of rotation. The air flow is drawn in axially by the fan-wheel from the housing air-inlet and is discharged peripherally therefrom into the housing structure to effect an enlarging spiral flow to a housing air-outlet. Generally, the fan-wheel comprises a series of circumferentially-spaced, radially-extending blades fixed between a pair of axially spaced plates. An annular element spans the housing interior to connect the housing air-inlet with the fan-wheel air-inlet.

It is well known that there are two distinct types of air currents that tend to circulate around the inside of this spiral housing chamber. One of these air currents is close to the front or air-inlet plate of the fan wheel. This current is caused by the "skin" friction of this front plate dragging the air along with it. Because of the high velocity of the fan wheel rotation, this skin-friction-induced air current tends to concentrate adjacent the face of this front plate and over the smaller diameter of the air-inlet element and move at a speed much faster than the more distant portions of the air flow through the housing.

The aforementioned skin-friction-induced air current also supplies the air that feeds the recirculation occurring between the high pressure air in the fan housing and the lower pressure air coming through the annular air inlet. This leakage occurs between the smaller diameter air inlet of the fan wheel plate and the innermost edge of the annular air inlet. Some recirculation is deemed desireable in order to assure complete "filling" of the fan wheel blades.

The other type of air current is the lower velocity air being discharged from the rotating fan wheel blades. This is the primary air flow which is directed out of the fan outlet to achieve useful work.

Many attempts have been made to merge the two air streams efficiently and direct them out of the fan outlet while still feeding the necessary recirculation between the fan wheel and air inlet. Some of the attempts deal only with the recirculation, while others deal only with "skimming" the skin friction air and directing it out of the outlet.

THE OBJECTS OF THE INVENTION

It is an object of this invention to provide centrifugal fans designed to operate with stable flow characteristics through a wide range of flow volume versus pressure ratios, and at the same time operating relatively quiet and with high efficiencies.

Fans of this character pertain to those commonly having blades inclined backwardly in relation to their rotation and with blade cross sections of air-foil shape, curved single thickness or straight single thickness. Such centrifugal fans, designed for high efficiencies, often tend to be unstable in performance at one or more ratios of volume to pressure.

BRIEF DESCRIPTION OF THE INVENTION

An important concept of this invention resides in a centrifugal fan having a plurality of improved vortex generators for interrupting the high velocity skin-friction current of air adjacent to the fan wheel front plate and flowing around the air inlet element, thus mixing said high velocity air with the slower moving air in the fan wheel housing being discharged from the fan wheel periphery; including a peripheral series of such vortex generators properly spaced on the air inlet element so as to effectively interrupt the high velocity skin friction induced air current circling the air inlet element adjacent to the fan wheel front plate; and a further concept is to provide vortex generators of this kind of such simple form as to permit variously contoured adaptations for various mounting in functioning position without deviating from the smooth inclined surface presented to the oncoming air.

Figure 1:
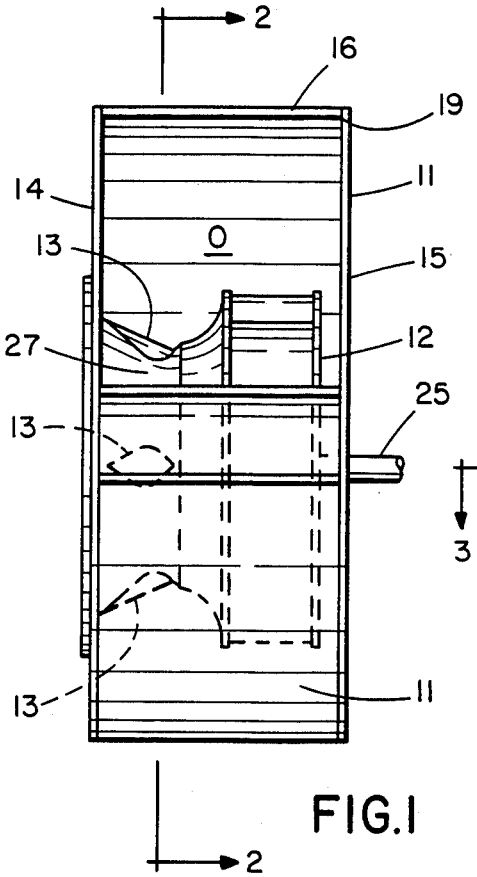
FIG. 1 is an elevational view of the discharge end of a centrifugal fan embodying vortex generators constructed and mounted in accordance with this invention.

An important concept of this invention resides in a peripheral series of vortex generators for scroll-type centrifugal fans, in the form of a butterfly shaped and contoured device mounted to smoothly interrupt the high velocity air current circling the air-inlet structure, and for causing it to be diverted outwardly for admixture with the lower velocity air current being expelled by the rotating fan wheel blades and being directed out of the fan discharge. A plurality of such generators is employed to prevent reestablishment of the skin-friction-induced air current.

The described construction, embodying the features of this invention, will cause the fan to have a stable performance through a much greater range of volume to pressure ratios than is ordinarily experienced, to develop higher efficiencies, and operate more quietly than heretofore obtained with this type of centrifugal fan.

DETAILED DESCRIPTION OF THE INVENTION

With reference now to the drawings, a centrifugal fan embodying the foregoing concept and designed to realize the above-expressed intent comprises a scroll-type housing 11, enclosing a fan-wheel 12 between which is arranged a peripheral series of vortex generators.

The housing 11 is a conventional structure formed of side walls 14 and 15 and a peripheral covering 16 bonded together along their respective perimeters. The side walls 14 and 15 have identical volute (spiral) perim- :ters centered about a predetermined axis 17 and, at heir opposite inner and outer extremities, terminate in ›arallel portions 18 and 19. The covering 16, bonded ılong its perimeters to the respective perimeters of the ide walls 14 and 15, defines a volute chamber C of ectangular cross-section embracing the fan-wheel 12 ınd terminating in an enlarging air-discharge outlet 0. The wall 14 is formed with an air-inlet 21, as in the side vall 14.

Figure 3:
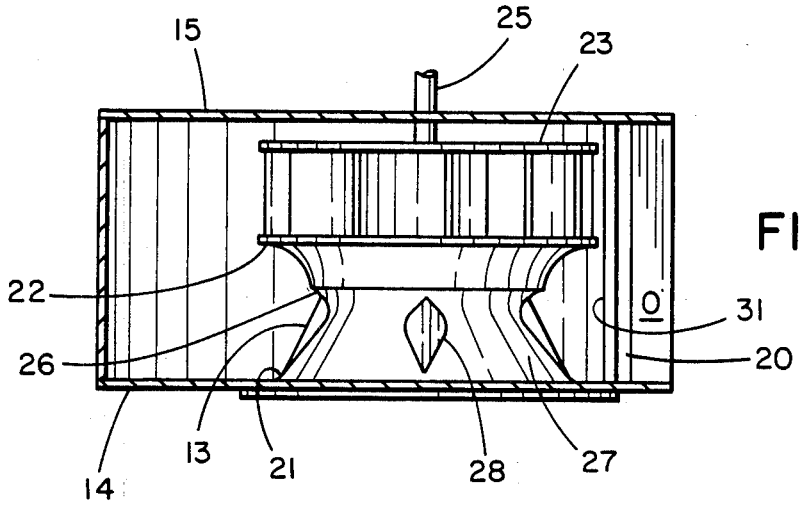
FIG. 3 is a horizontal, sectional view taken on the line 3—3 of FIG. 2.
Figure 4:
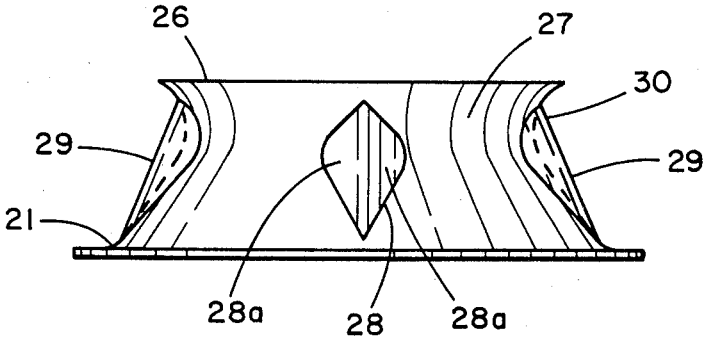
FIG. 4 is a side elevational view of the air-inlet element showing a vortex generator mounted thereon.
Figure 5:
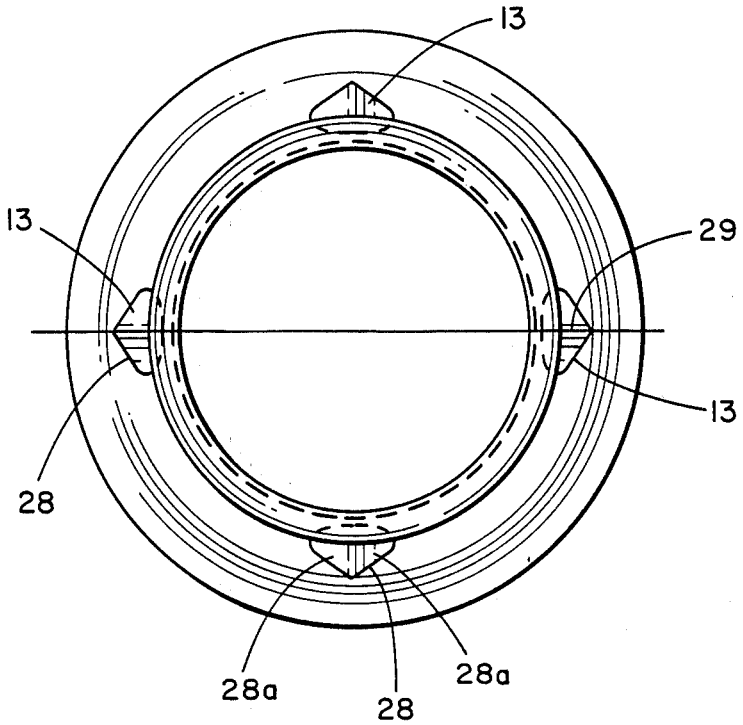
FIG. 5 is a front view of the element of FIG. 4.
Figure 10:
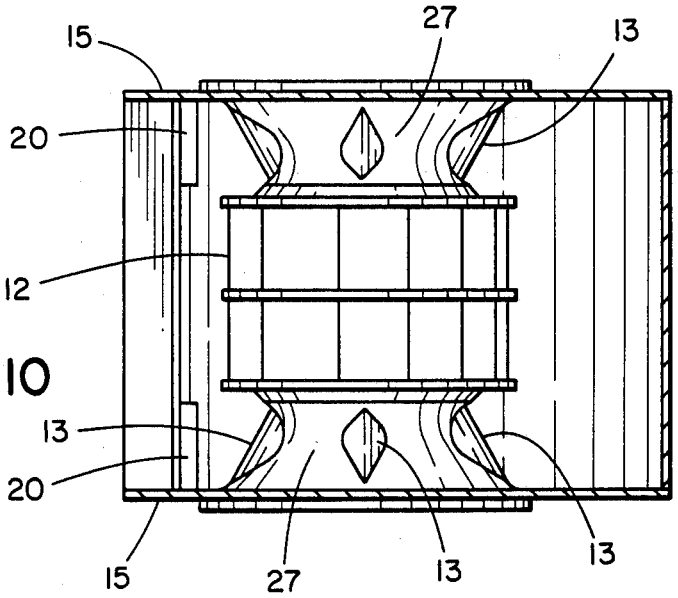
FIG. 10 is a view showing a double fan-wheel construction with vortex generators in accordance with this invention.

The housing 11, herein shown, includes a particular orm of cut-off sheet 20, shaped to continue upwardly ınd inwardly the volute air-flow chamber C to a point :losely embracing the fan-wheel 12. The use of such a :ut-off sheet 20, of course, is optional. Its use depends ıpon the over-all conditions under which the centrifu- ;al blower is to be used. When used, such a cut-off sheet !0 may extend across the major portion of the space ›etween the housing wall 14 and the fan wheel 12, as hown in FIG. 3, or it may extend only across the space ›etween the housing sides 14 and 15 and the fan-wheel .2, as shown in FIG. 10.

The fan-wheel 12 is a more or less conventional struc- ure comprising a pair of inner and outer plates 22 and !3 secured in axially-spaced relationship by an annular eries or radially-disposed vanes 24. The dimension of he plates 22 and 23 and the shape, angle and dimensions ›f the vanes 24 may well depend upon the particular use vhereto such a centrifugal blower is to be put. The an-wheel 12, as here shown, is fixed to a shaft 25 jour- ıaled on suitable bearing (not here shown) on the side valls 14 and 15 concentric with the axis 17 on the hous- ng volute chamber C. The inner plate 22 has a central .ir-inlet opening 26 which is communicatively con- ıected by an annular element 27 to the air-inlet 21 of the ıousing wall 14.

The element 27, often referred to as an "inlet-cone", s illustrated as a concave annular form tapered in- vardly from the larger diameter air-inlet 26 in the fan- vheel plate 22.

The vortex generators 13 are shown as formed plates vith the lateral edges 28 contoured to fit the curved ınnular wall of the inlet-cone 27.

Figure 6:
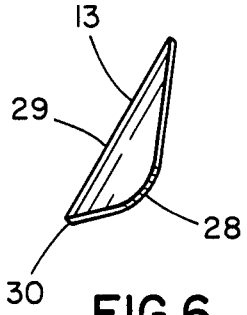
FIGS. 6–9 are perspective views of differently contoured vortex generators and mounting therefor constructed in accordance with this invention.

In FIG. 6, the vortex generator is illustrated as a ingle piece having a perfectly flat upper surface. A ›lurality of such vortex generators 13 are mounted on he outer peripheral wall of the inlet-cone 27 so that axis !9 of the generators is in general alignment with the fan vheel shaft. In order to achieve the desired results, the nner end 30 should be located such that the vortex air :urrent recirculating between the smaller diameter air nlet of the fan wheel front plate and the innermost edge ›f the annular air inlet is not interrupted, since, as previ- ›usly described, this recirculation is desireable.

In general, the vortex generators are formed of later- ıll spaced apart side walls 28*a* which extend curvilin- :arly, both radially and circumferentially from the cir- :umferentially spaced lateral edges 28 and which merge ılong a line 29 which extends radially in general align- nent with the fan-wheel shaft. The lateral edges 28 ıave their widest spacing intermediate to ends and pref- :rably nearest the inner end and then taper therefrom ;radually to the end points.

In practice, it is desirable to make use of at least four ;enerators equally spaced circumferentially about the ınnular element. While more can be used, proportional ncrease in effectiveness does not justify the use of more han eight generators, the number, of course, depending omewhat on the size of the fan.

The inclined profile of the vortex generator as defined by axis 29 and contour 28 effectively intercepts the high velocity air current with the greater profile or offset from the cone surface being exposed at the smallest diameter of the air inlet-cone 27 and gradually diminishing as the generator extends up and outward toward the housing side wall 14. Thus, the vortex generator presents a variable profile to the airstream, being more prominent by extending outwardly farther where the velocity is highest and gradually diminishing in the area where the air velocity approaches that of the air being discharged from the fan wheel.

Figure 7:
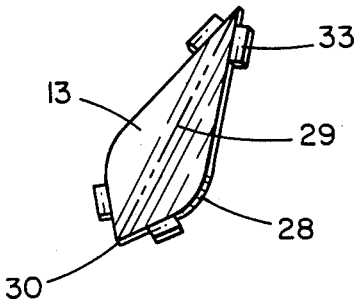
Figure 8:
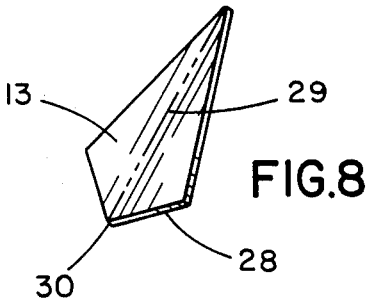

Various means can be provided for fixing the vortex generator 13 in its proper relationship to the inlet-cone 27 and the fan wheel 12. It is desirable that the contoured edge 28 be in contact with the exterior face of the element 27 in two or more places and as is important that the point 30 be spaced but a short distance from the plate 22 of the fan wheel 12. It is essential that the end of the generator 30 fit fairly tightly to the surface of the inlet cone 27 so as not to create a noise generating orifice. The generator 13 should effectively interrupt the high velocity air circling the element 27 but with minimum interference with recirculating air between 26 and 27. The preferred form of mounting would be by resistance welding or adhesion of vortex generator 13 to element 27. Another form of mounting is shown in FIG. 7 wherein tabs 33 are provided on the generator 13 for attachment to element 27, as by fasteners such as sheet metal screws.

Figure 9:
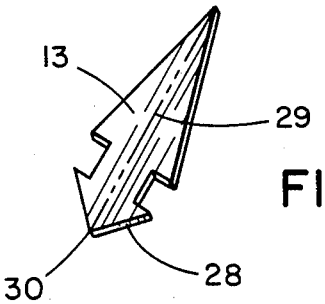

On fans incorporating internal variable volume dampers mounted on element 27, it is desirable to notch edge 28 of the generator, as in FIG. 9, in order to clear the internal operating mechanism of the damper.

The structuring of the housing 11 about fan wheel 12, as illustrated, operates to slow down the air discharge from the outlet 0 to a desirable velocity in a manner that effects the greatest possible recovery (regain) of static pressure during the conversion from the high velocity discharge from the fan wheel 12.

Figure 2:
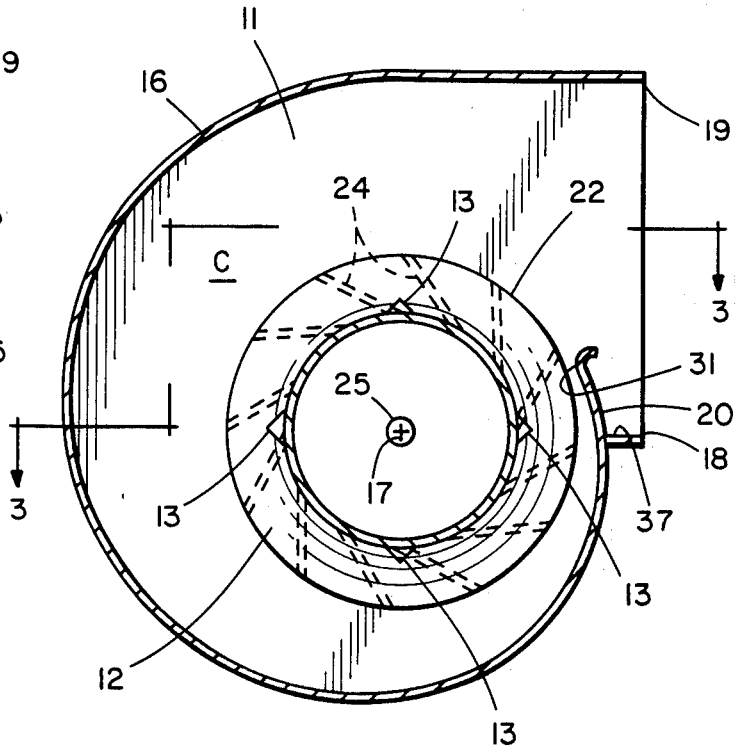
FIG. 2 is a vertical, sectional view taken on the line 2—2 of FIG. 1.

As previously described, the high velocity rotation of the fan wheel 12 in the volute chamber C of the housing 11 creates two distinct types of air current circulating within chamber C, outside of the fan wheel 12. One such air current tends to continue the circular movement created by the fan wheel and re-enter through the narrow throat I (FIG. 2) between the annular element (inlet-cone) 27 and the inner perimeter of the air-outlet 0, at 31 or 37 (FIG. 2). Such recirculation of air should be arrested as much as possible in order to create a larger volume of air flow through the discharge-outlet 0 of the housing 11. This is accomplished as one of the junctions of the vortex generator 13.

The operation of a centrifugal fan with a peripheral series of vortex generators constructed and positioned in accordance with the practice of this invention will be obvious from the foregoing explanation.

It will be understood that changes may be made in the details of the construction and operation without departing from the spirit of the invention as defined by the following claims.

I claim:

1. A centrifugal fan comprising:

(a) a scroll type housing, (b) a bladed fan-wheel mounted for rotational movement within said housing said fan-wheel having a side plate with an axial air-inlet to the wheel, (c) an air-inlet in one wall of the housing, (d) an annular member connecting the housing inlet with the fan-wheel air-inlet, (e) a series of formed vortex generators secured to the outer wall of the annular member in circumferentially spaced apart relation between the air-inlet wall of the fan-wheel and the air-inlet housing wall with the axial ends spaced a short distance from said walls, said vortex generators having a spine in substantial alignment with the axis of the fan-wheel and having a continuous surface defined within a closed circumference, the circumference being substantially in tight engagement with the exterior surface of the annular element wherein air is restricted from entry into the interior of the vortex generator, the vortex generators having a profile defined above the level of the annular member and along the axis of the spine, said profile having a maximum displacement from the annular member intermediate said axial ends and said profile decreasing to substantially zero at both ends of the vortex generators whereby the vortex generators interrupt an air current created by skin friction of the air-inlet wall of the fan-wheel as the current passes axially outward over the annular member, the vortex generator creates turbulence and mixing between the slower moving air current discharged from the wheel blades and the air current created by skin friction of the air-inlet wall of the fan-wheel but without interfering with the recirculation of air between the air-inlet of the fan-wheel and the innermost portion of the annular inlet, restricting the recirculation of the velocity air currents within the housing by causing mixing thereof with slower velocity air discharged from the fan outlet.

2. A centrifugal fan as claimed in claim 1, in which the vortex generators are dimensioned to have a length in the axial direction substantially equal to the axial dimension of the annular member.

3. A centrifugal fan as claimed in claim 1, in which the lower lateral edges of the generators conform to the exterior surface of the annular member.

4. A centrifugal fan as set forth in claim 1, in which the profile of the vortex generators defines a generally flat contour mounted with an incline in the direction toward the fan-wheel rotation, thereby to present a profile to the high velocity air current.

5. A centrifugal fan as claimed in claim 1, which includes tabs extending from the contoured edges of the generators, and fastening means securing the tabs to the outer surface of the annular member.

6. A centrifugal fan as claimed in claim 1, in which the vortex generators are generated by a series of straight cuts.

7. A centrifugal fan as claimed in claim 1 wherein the circumference of the vortex generators are relieved to allow the placement over variable volume inlet damper mechanisms.

8. A centrifugal fan as claimed in claim 1 in which the continuous surface of the vortex generators define circumferentially spaced side walls which extend curvilinearly radially and circumferentially upwardly from the circumference which is substantially in tight engagement with the exterior surface of the annular element merging to form the profile generally along the axis of the spine.

9. A centrifugal fan as claimed in claim 8 in which the side walls of each vortex generator are spaced farthest apart intermediate the axial ends with the widest spaced portion nearest the inner end.

10. A centrifugal fan as claimed in claim 8 in which the vortex generator is relatively dome shaped with a flattened top extending radially at an incline from the rearward end portion to the forward end portion.

* * * * *